US006658715B1

(12) United States Patent
Podesta'

(10) Patent No.: US 6,658,715 B1
(45) Date of Patent: Dec. 9, 2003

(54) METHOD OF PRODUCING AN ELEMENT OF COMPOSITE MATERIAL

(75) Inventor: Emanuele Podesta', Brindisi (IT)

(73) Assignee: FiatAvio S.p.A., Turin (IT)

( * ) Notice: Subject to any disclaimer, the term of this patent is extended or adjusted under 35 U.S.C. 154(b) by 103 days.

(21) Appl. No.: 09/699,741

(22) Filed: Oct. 30, 2000

(30) Foreign Application Priority Data

Nov. 4, 1999 (EP) ..... 99830693

(51) Int. Cl.[7] ..... B23P 17/00

(52) U.S. Cl. ..... 29/419.1; 29/889.71; 228/190; 428/615

(58) Field of Search ..... 29/419.1, 469.5, 29/889.71; 228/190, 193; 419/49, 5, 10; 428/545, 615

(56) References Cited

U.S. PATENT DOCUMENTS

| | | | | |
|---|---|---|---|---|
| 3,864,807 A | | 2/1975 | Schneider | 29/419 |
| 5,427,304 A | * | 6/1995 | Woods et al. | 228/190 |
| 5,460,774 A | | 10/1995 | Bachelet | 419/5 |
| 5,562,245 A | * | 10/1996 | Berthelemy et al. | 228/190 |
| 5,946,801 A | * | 9/1999 | Twigg et al. | 29/889.71 |

FOREIGN PATENT DOCUMENTS

| | | |
|---|---|---|
| EP | 0490629 | 6/1992 |
| EP | 0667207 | 8/1995 |
| EP | 0831154 | 3/1998 |
| EP | 0846550 | 6/1998 |
| GB | 1155708 | 6/1969 |
| WO | 9811265 | 3/1998 |

OTHER PUBLICATIONS

Ponzi C: "Metal Matrix Composite . . . Structures"; Composites Manufacturing; GB; Butterworth Scientific; Guildford; Surrey; vol. 3, No. 1 Jan. 1992, pp. 32–42.

* cited by examiner

*Primary Examiner*—David P. Bryant
(74) *Attorney, Agent, or Firm*—Ladas & Parry

(57) ABSTRACT

A method of producing an element of composite material, including the steps of forming a first distribution of first elements defining the matrix of the element of composite material; forming a second distribution of second elements defining the reinforcing structure of the element of composite material; and compacting the first and second elements to obtain a distribution of the reinforcing structure inside the matrix; the first elements being metal wires; and the step of forming the first distribution including the step of assigning each second element an orderly distribution of metal wires.

14 Claims, 4 Drawing Sheets

METHOD OF PRODUCING AN ELEMENT OF COMPOSITE MATERIAL

The present invention relates to a method of producing elements of composite material, in particular, circular-geometry elements such as countershafts, turbine and compressor disks for turbomachines, etc.

BACKGROUND OF THE INVENTION

As is known from Italian Patent Application n. TO96A000979 filed on Dec. 3, 1996 by FIATAVIO S.p.A, composite-material elements of the above type are produced by forming a number of disks, each formed by winding a continuous reinforcing fiber about an axis to form a flat spiral; stacking the disks with the interposition of respective spacer sheets of metal material; and axially compacting the stack to form a metal matrix in which the various spirals of reinforcing fibers are embedded.

The physical characteristics of such composite-material elements depend mainly on the distribution of the reinforcing fibers inside the metal matrix; and the extent to which the fibers are distributed evenly depends on the extent to which the turns in each disk are equally spaced a predetermined distance apart, and the extent to which the freedom of movement of the various turns is restricted, especially at the compacting stage.

For which reason, the turns of reinforcing fiber are locked in place with respect to one another by fastening wires wound about each turn and extending spokefashion with respect to the axis of the spiral.

More specifically, the turns are equally spaced a given distance apart by forming, alongside formation of the spiral, a further two flat spirals of spacer wire, which are removed from the spiral of reinforcing fiber once the fastening wires are wound about the turns.

The method described briefly above involves several drawbacks.

In particular, producing composite-material elements using disks of reinforcing material and metal spacer sheets of given thicknesses means it is impossible to obtain any given desired distribution of the reinforcing fibers inside the metal matrix.

Moreover, the above method comprises various fairly complex, and therefore fairly high-cost, operations (weaving the spirals of reinforcing wire separately and fastening the relative turns; stacking the disks of ceramic material and spacer sheets; and placing the stacks inside a final container to form the composite-material elements).

In the case of a titanium metal matrix, the spacer sheets are not easy to procure in the form required by the methods described, i.e. of constant 0.1 mm thickness, and call for various dedicated machining operations (cutting, grinding, welding, etc.) which further increase the already high cost involved.

Finally, the fastening wires must be made of inert material, with respect to both the metal matrix and the reinforcing fibers.

SUMMARY OF THE INVENTION

It is an object of the present invention to provide a method of producing an element of composite material, designed to eliminate in a straightforward, low-cost manner the aforementioned drawbacks typically associated with known methods.

According to the present invention, there is provided a method of producing an element of composite material comprising a metal matrix and a reinforcing structure, said method comprising the steps of:

forming a first distribution of first elements defining said matrix;

forming a second distribution of second elements defining said reinforcing structure; and compacting said first and second elements to obtain a distribution of said reinforcing structure inside said matrix;

characterized in that said first elements are metal wires; and in that said step of forming said first distribution comprises the step of assigning each said second element an orderly distribution of said metal wires.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
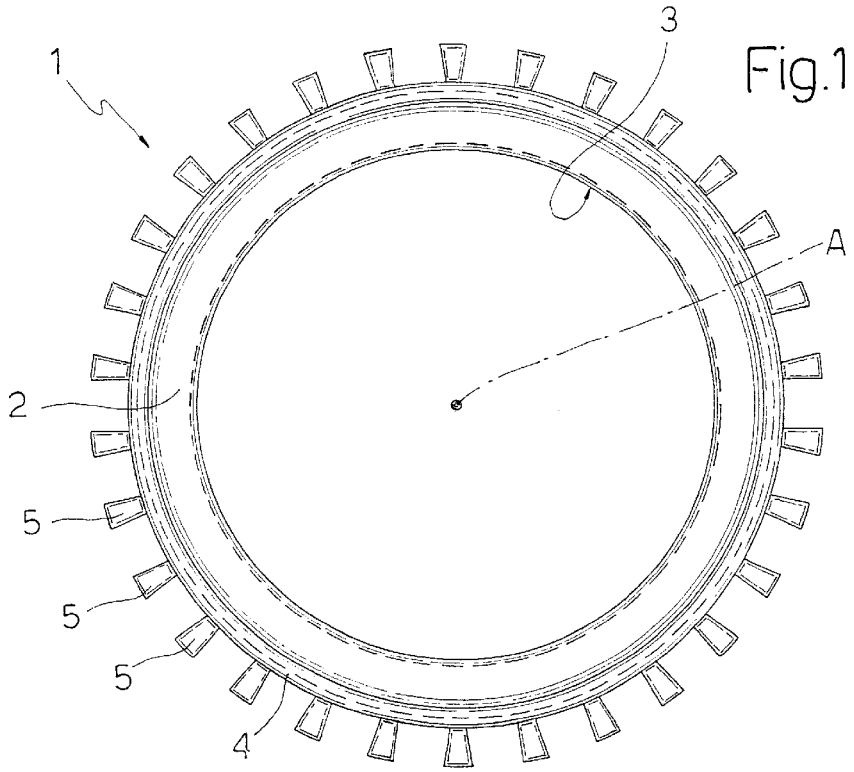
FIG. 1 shows a front view of an element of composite material formed in accordance with the present invention.
Figure 2:
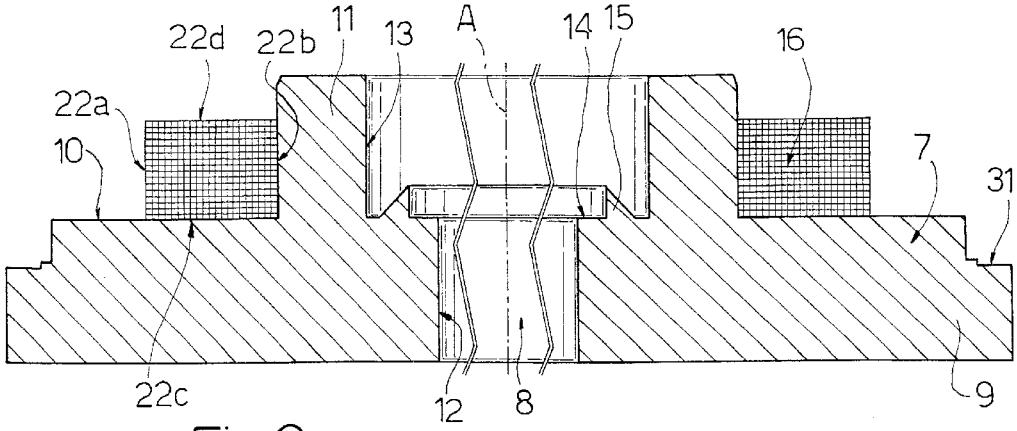
FIG. 2 shows an axial section of a supporting body with a ring of composite material, from which the FIG. 1 element is formed using the method according to the present invention.
Figure 4:
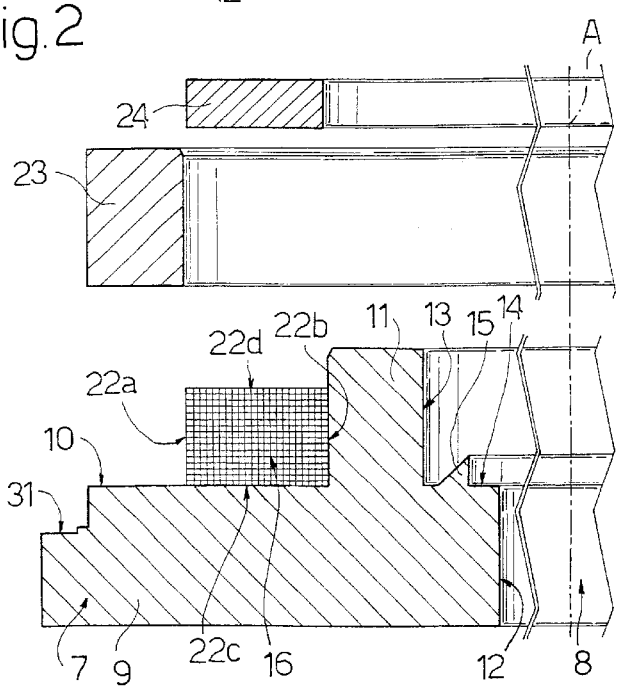
FIGS. 4 to 9 show partial axial sections of successive operating steps in the formation of the FIG. 1 element according to the method of the present invention.
Figure 5:
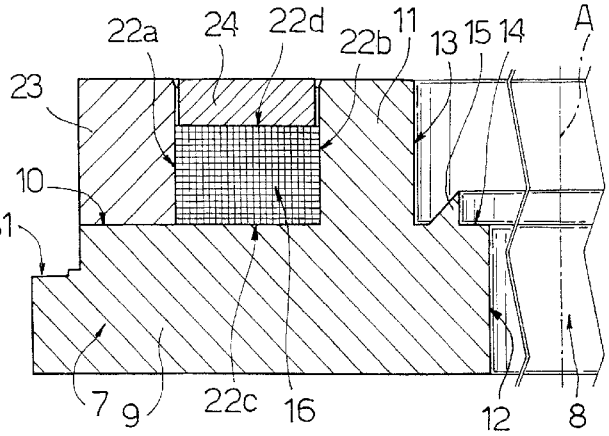

Number 1 in FIG. 1 indicates as a whole an element of composite material formed using the method according to the present invention—in the example shown, a rotary member, such as a compressor disk for turbomachines, to which the following description refers purely by way of example.

Element 1 is of circular annular shape with an axis of symmetry A, and comprises a central portion 2 in the form of a flat disk and defining a through hole 3 of axis A, and a substantially cylindrical peripheral portion 4 projecting axially in both directions with respect to central portion 2 and supporting externally a number of projecting radial blades 5.

More specifically, central portion 2 is made of a composite material defined by a matrix of metal material —in the example shown, titanium alloy—and by a reinforcing structure of ceramic material—in the example shown, silicon carbide—and is coated externally with a thin layer of metal or so-called "skin", preferably of titanium alloy.

Peripheral portion 4, on the other hand, is made entirely of metal material, advantageously the same material as the matrix of central portion 2.

Element 1 is formed by preparing and then compacting a toroidal base structure 6 (FIG. 6) of axis A.

Structure 6 is formed from a substantially annular main body 7 (FIGS. 2, 4–9) comprising a through hole 8 of axis A defining hole 3 of element 1, and a disk-shaped portion 9, from a flat end surface 10, perpendicular to axis A, of which projects axially a cylindrical tubular portion 11 having an outside diameter smaller than the outside diameter of disk-shaped portion 9.

Hole 8 is defined at portions 9 and 11 by respective cylindrical surfaces 12, 13 having different diameters and connected to each other by a flat intermediate surface 14 perpendicular to axis A and extending along an extension of end surface 10. More specifically, cylindrical surface 12 is larger in diameter than cylindrical surface 13.

Main body 7 also comprises an annular projection 15, of axis A, projecting inside hole 8 from intermediate surface 14 and having a right-triangular section with the hypotenuse facing cylindrical surface 13.

Base structure 6 is formed as follows.

First of all, a first distribution of metal wires 20 defining the metal matrix of element 1, and a second distribution of fibers 21 of ceramic material defining the reinforcing structure of element 1 are positioned coaxially on main body 7.

Figure 3:
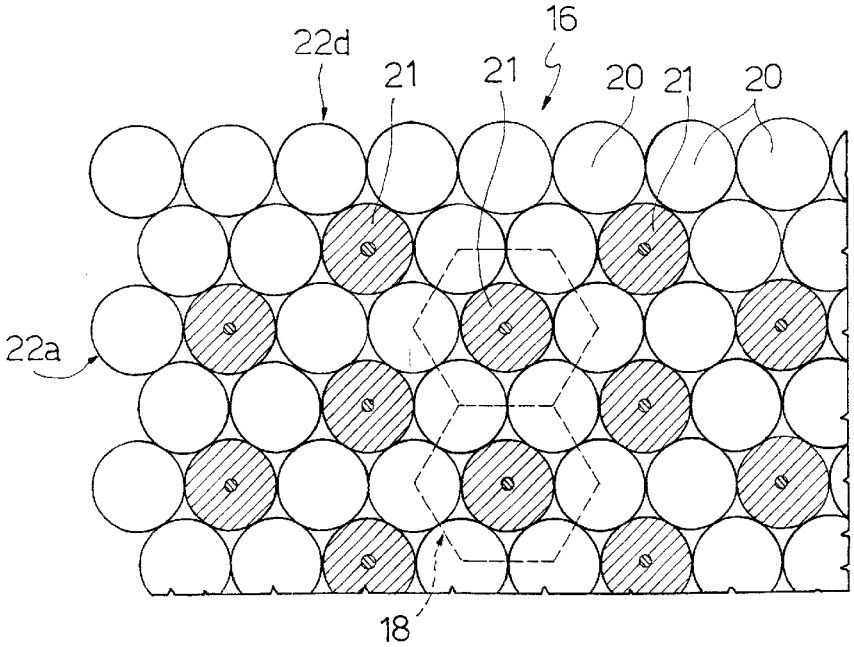
FIG. 3 shows a larger-scale view of a detail of the FIG. 2 ring.

An important characteristic of the present invention is that the first distribution is formed by assigning each fiber 21 an orderly distribution of metal wires 20. Wires 20 and fibers 21 together define a composite-material ring 16 (FIG. 2) woven on a known winding machine not shown. In the example shown, wires 20 and fibers 21 are annular with a circular section (FIG. 3) and are made respectively of titanium alloy and silicon carbide.

More specifically, ring 16 is positioned coaxially about tubular portion 11 of main body 7, and rests on end surface 10 of disk-shaped portion 9.

Wires 20 and fibers 21 are advantageously combined in a weave pattern (FIG. 3) in which two wires 20 are interposed between each pair of fibers 21. More specifically, in the weave pattern, each fiber 21 is surrounded by six wires 20 forming the vertices of a hexagon, and occupies the barycenter of the hexagon.

Ring 16 is defined externally by a radially outer and radially inner cylindrical lateral surface 22*a*, 22*b*, and by two opposite flat annular end surfaces 22*c*, 22*d*; which surfaces 22*a*, 22*b*, 22*c*, 22*d* are made exclusively of metal wires 20 for ensuring, after the compacting step, the structural continuity of ring 16, main body 7 and the other metal parts of structure 6 described in detail later on.

Wires 20 and fibers 21 have the same diameter and together define a number of hexagonal base cells 18 (shown by the dash lines in FIG. 3); and each base cell 18 is defined by a central fiber 21 and by respective 120° angular portions of the six wires 20 surrounding central fiber 21, so that the volume of the reinforcing structure is 33% that of the matrix.

Structure 6 is completed by fitting main body 7 coaxially with two annular closing elements 23, 24 (FIGS. 4 and 5) and a cover 25 (FIG. 6), which, together with main body 7, define a closed seat for ring 16.

With particular reference to FIGS. 4–9, closing element 23 is the same axial height as tubular portion 11 of main body 7, while the axial height of closing element (or piston ring) 24 equals the difference between the axial heights of tubular portion 11 and ring 16.

Closing element 23 is fitted onto the radially outer surface 22*a* of ring 16 so as to rest on end surface 10 of disk-shaped portion 9 of main body 7; and, similarly, closing element 24 is inserted between tubular portion 11 of main body 7 and closing element 23 so as to rest on end surface 22*d* of ring 16, on the opposite side to disk-shaped portion 9.

Cover 25 comprises a circular, annular, disk-shaped wall 28, from the radially inner and outer peripheral edges of which project respective concentric inner and outer cylindrical walls 29, 30.

Figure 6:
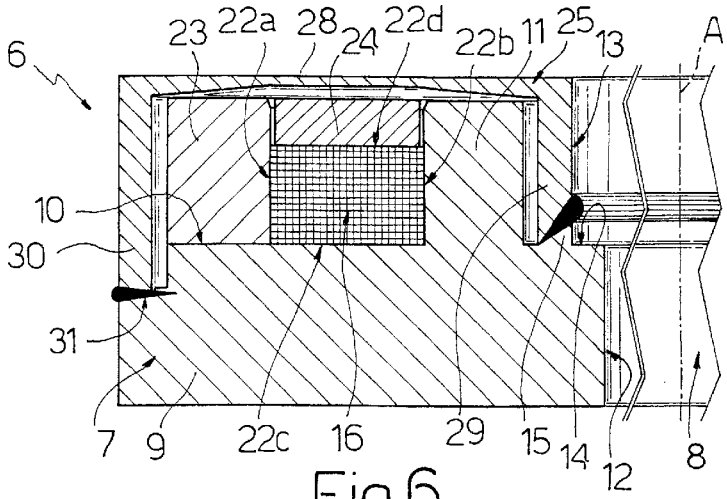

Cover 25 is assembled by positioning disk-shaped wall 28 facing respective free axial ends of closing elements 23, 24 and tubular portion 11 of main body 7, and by inserting cylindrical wall 29 inside hole 8 so that the end rests on projection 15, and by fitting cylindrical wall 30 on the outside of closing element 23 so that the end rests on a peripheral annular shoulder 31 of disk-shaped portion 9 of main body 7 (FIG. 6).

Cover 25 is then fixed to main body 7 by spot welding the portions contacting projection 15 and shoulder 31.

At this point, the air inside structure 6 is extracted using a known molecular pump (not shown) and a known muffle furnace (not shown) for heating structure 6 to a temperature of about 600° C.

The resulting structure 6 is compacted in a conventional autoclave (not shown) for HIPping (Hot Isostatic Pressing) processing with automatic temperature and pressure control.

At the first stage, lasting about two hours, the temperature of the autoclave, initially at ambient conditions, is increased to the superplasticity temperature of the titanium alloy—in the example described, about 900° C.

Figure 7:
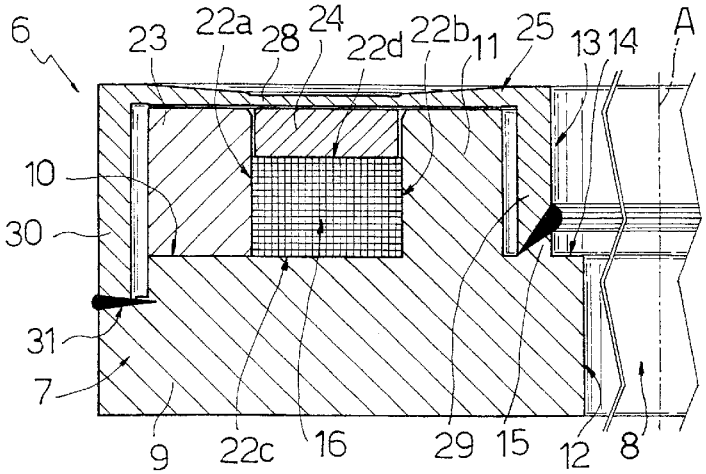
Figure 8:
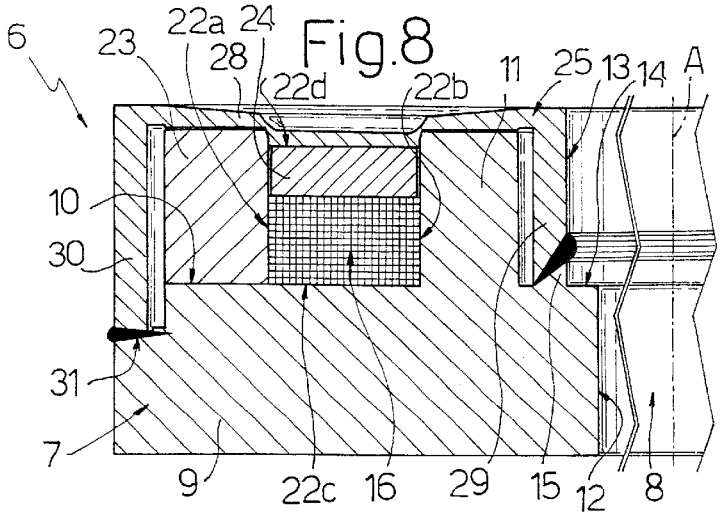

The temperature in the autoclave is then maintained constant long enough to enable the entire mass defining structure 6 to reach a uniform temperature. This period of time—two hours on average—is calculated bearing in mind that heat transmission at this stage is slowed down by the absence of air inside structure 6, and by the fact that the contact area between wires 20 of surfaces 22*a*, 22*b*, 22*c*, 22*d* of ring 16 and main body 7 is extremely small and therefore permits very little heating by conduction of wires 20. At the same time, the pressure inside the environment housing structure 6 and defined by the autoclave is increased to such a threshold value—in the example described, 900 Kg/cm2—as to permanently deform disk-shaped wall 28 of cover 25 in a direction parallel to axis A (FIG. 7). More specifically, disk-shaped wall 28 of cover 25 flexes so as to come to rest on closing element 24, which in turn presses against composite-material ring 16 to act as a pressure equalizer and transmitter. Once disk-shaped wall 28 of cover 25 is so deformed as to enable closing element 24 to axially stress composite-material ring 16, metal wires 20 are deformed so as to fill the gaps formerly present between wires 20 and fibers 21. At this stage, composite-material ring 16 contracts along axis A, while the position of fibers 21 with respect to axis A remains constant to ensure uniform distribution of the reinforcing structure inside the metal matrix.

Figure 9:
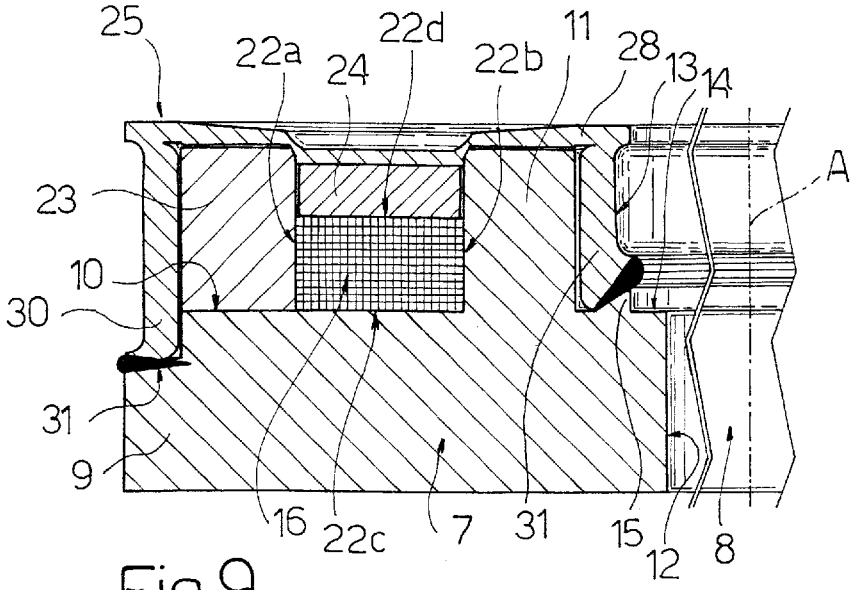

At this point, the pressure inside the autoclave is increased further to such a threshold value—in the example shown, about 1300 Kg/cm2—as to collapse the whole of structure 6, which is also compacted crosswise to axis A (FIG. 9). More specifically, cylindrical walls 29, 30 of cover 25 adhere respectively to a radially outer surface of closing element 24 and to surface 13 defining hole 8, while composite-material ring 16 adheres along metal peripheral surfaces 22*a*, 22*b*, 22*c*, 22*d* to disk-shaped and tubular portions 9, 11 of main body 7 and to closing elements 23 and 24.

The compacted structure 6 is then cooled by so reducing the temperature and pressure as to minimize the residual stress produced in the portion derived from composite-material ring 16 by the different coefficients of thermal expansion of the metal matrix and reinforcing fibers 21.

Figure 10:
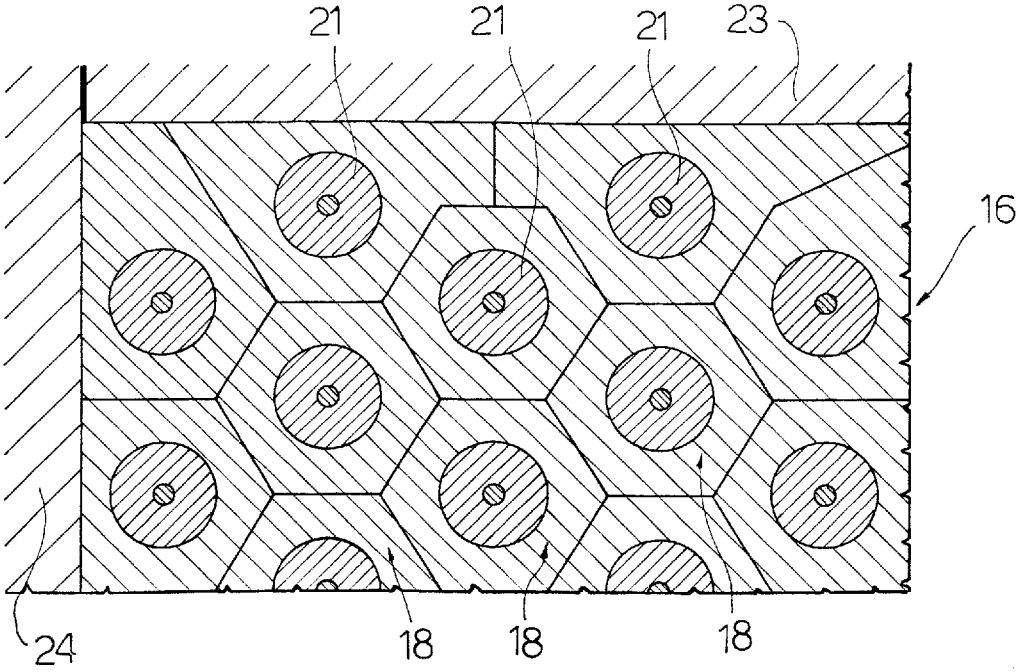
FIG. 10 shows the FIG. 3 detail following application of the method according to the present invention.

The portion of element 1 derived from ring 16 assumes the FIG. 10 configuration, in which fibers 21 are evenly distributed inside the metal matrix, are equally spaced in a direction perpendicular to axis A, and are separated by varying distances in a direction parallel to axis A.

Finally, the compacted structure 6 may be subjected to mechanical machining or similar to obtain the finished contour of element 1. In particular, blades 5 are formed from the part of compacted structure 6 derived from disk-shaped portion 9 of main body 7.

Using metal wires 20 to form the matrix of composite-material element 1 therefore provides, by appropriately selecting the diameter of wires 20 and fibers 21, for obtaining any desired distribution of the reinforcing structure inside the metal matrix.

In particular, by appropriately selecting the type of distribution of metal wires 20 relative to each reinforcing fiber 21, e.g. by adopting the hexagonal distribution described previously, the freedom of movement of fibers 21 can be limited during compaction to maintain the positions of fibers 21 with respect to axis A.

Moreover, unlike known methods, the method described provides for forming composite-material element 1 by weaving wires 20 and fibers 21 directly onto parts (main body 7) eventually forming part of the metal matrix of element 1, thus eliminating the need for producing separate disks of reinforcing wire, fastening the turns of each disk, the long, complicated process of stacking the disks with respective metal spacer sheets in between, and placing the stacks inside containers for producing elements 1.

The spacer sheets, which are particularly expensive when titanium-based, and the work involved in preparing the sheets may therefore be eliminated with considerable saving.

Finally, contraction of structure 6 at the compacting stage is less than that of stacks of ceramic disks and metal spacer sheets using the known methods described previously.

Clearly, changes may be made to the method described and illustrated herein without, however, departing from the scope of the accompanying Claims.

In particular, reinforcing fibers 21 may be made of different materials, including metal.

Main body 7, closing elements 23, 24 and cover 25 may be made of different metal materials from each other and from the material of wires 20.

Finally, once formed, composite-material ring 16 may even be extracted from structure 6 and used to form different composite-material elements.

What is claimed is:

1. A method of producing an element of composite material (1) comprising a metal matrix and a reinforcing structure, said method comprising the steps of:

forming a first distribution of first elements (20) defining said matrix;

forming a second distribution of second elements (21) defining said reinforcing structure; and compacting said first and second elements (20, 21) to obtain a distribution of said reinforcing structure inside said matrix;

wherein said first elements are metal wires (20); and said step of forming said first distribution comprises the step of assigning each said second element (21) an orderly distribution of said metal wires (20) such that that said metal wires surround said second elements and each second element is separated from all other second elements by said metal wires and said second elements will be surrounded by said metal matrix as a composite therewith in which the second elements of said reinforcing structure will be spaced from one another, wherein said second elements are reinforcing fibers, wherein said assigning step comprises the step of preparing a woven element (16) by placing at least one said metalwire (20) alongside each said reinforcing fiber (21), wherein said metal wires (20) and said reinforcing fibers (21) are annular and said woven element forms a ring; and said step of preparing said woven element (16) is performed by placing said metal wires (20) and said reinforcing fibers (21) about a toroidal main body (7) made of metal material, further comprising the step of forming a base structure (6) by fitting covering means (23, 24, 25) of metal material onto said main body (7) to close said woven element ring (16) between said main body (7) and the covering means (23, 24, 25), wherein said main body, (7) and said covering means (23, 24, 25) define, at the end of said compacting step, respective peripheral portions of said element of composite material (1); and said woven element ring (16) defines, at the end of said compacting step, a core of said element of composite material (1), wherein said compacting step comprises the steps of:

placing said base structure (6) in an environment of controllable temperature and pressure conditions;

heating said environment so as to bring said metal wires (20), said main body (7) and said covering means (23, 24, 25) uniformly to a superplasticity temperature and applying a first pressure thereto to axially compact said woven element ring to fill the gaps between the individual wires and the fibers in a first compaction step; and thereafter applying a pressure higher than the first pressure to compact the structure in all directions to collapse and bond together the axially compacted woven element ring (16) said main body (7) and said covering means (23, 24, 25).

2. A method as claimed in claim 1, wherein said step of preparing said woven element (16) comprise the step of interposing at least two said metal wires (20) between each pair of adjacent said reinforcing fibers (21).

3. A method as claimed in claim 1, wherein said step of preparing said woven element (16) comprises the step of surrounding each said reinforcing fiber (21) with six said metal wires (20) forming the vertices of a hexagon.

4. A method as claimed in claim 3, wherein said step of preparing said woven element (16) comprises the step of positioning each said reinforcing fiber (21) at the barycenter of the hexagon defined by said metal wires (20) about the reinforcing fiber (21).

5. A method as claimed in claim 1, wherein said step of preparing said woven element (16) comprises the step of forming respective boundary surfaces **(22*a*, 22*b*, 22*c*, 22*d*) of the woven element (16) using exclusively said metal wires (20)**.

6. A method as claimed in claim 1, wherein said metal wires are made of a titanium-alloy-based material.

7. A method as claimed in claim 1, wherein said reinforcing fibers are made of ceramic material.

8. A method as claimed in claim 7, wherein said reinforcing fibers are made of silicon-carbide-based material.

9. A rotary member (1) made of composite material and obtained by the method of claim 1 comprising a structure of metal material (4) and a reinforcing element (2, 16) of composite material; wherein said reinforcing element (2, 16) is obtained from an orderly distribution of metal wires (20) and reinforcing fibers (21), and has respective boundary surfaces **(22*a*, 22*b*, 22*c*, 22*d*) made exclusively from said metal wires (20) and connected integrally by compaction to said structure of metal wires (20)** and connected integrally by compaction to said structure of metal d composite in which said reinforcing fibers are spaced from one another.

10. A rotary member as claimed in claim 9, wherein said orderly distribution of metal wires and reinforcing fibers comprises a succession of layers, each of which includes said metal wires and said reinforcing fibers placed next to one another, and wherein in each layer, each reinforcing fiber is in contact with adjacent metal wires and in successive layers each reinforcing fiber is in contact with said metal wires in preceding and subsequent layers.

11. A method as claimed in claim 1, wherein said steps of forming said first and second distribution of said first and second elements comprises forming successive layers which include said first and second elements in each layer and wherein in each layer, each reinforcing fiber is in contact with adjacent metal wires and in successive layers each reinforcing fiber is in contact with said metal wires in preceding and subsequent layers.

12. A method as claimed in claim 1, wherein in said second compaction step the pressure of said environment is increased to produce radial overall compaction of said element of composite material.

13. A method as claimed in claim 12 wherein said covering means includes an annular member covering said element of composite material and, upon increasing the pressure in said first compaction step, causing said annular member to axially compress said element of composite material.

14. A method as claimed in claim 13 comprising forming said annular member of a deformable material and producing said axial pressure on the element of composite material by deforming said annular member.

* * * * *